US005253015A

United States Patent [19]

Morita et al.

[11] Patent Number: 5,253,015

[45] Date of Patent: Oct. 12, 1993

[54] SHEET LOAD SYSTEM FOR IMAGE FORMING APPARATUS

[75] Inventors: Shizuo Morita; Masakazu Fukuchi; Shunji Matsuo; Satoshi Haneda, all of Hachioji, Japan

[73] Assignee: Konica Corporation, Tokyo, Japan

[21] Appl. No.: 893,893

[22] Filed: Jun. 4, 1992

Related U.S. Application Data

[63] Continuation of Ser. No. 672,023, Mar. 19, 1991, abandoned.

[30] Foreign Application Priority Data

Mar. 22, 1990 [JP] Japan ..... 2-72705
Mar. 22, 1990 [JP] Japan ..... 2-72706

[51] Int. Cl.[5] ..... G03G 21/00

[52] U.S. Cl. ..... 355/210; 271/127; 271/164; 355/308

[58] Field of Search ..... 355/210, 212, 308, 309, 355/311; 271/126, 127, 162, 164

[56] References Cited

U.S. PATENT DOCUMENTS 3,499,645 3/1970 Noda et al. ..... 271/162
4,483,607 11/1984 Nagayama ..... 355/212
4,740,817 4/1988 Suzuki et al. ..... 355/315
4,827,308 5/1989 Howard et al. ..... 355/271
4,951,095 8/1990 Warden ..... 355/273
4,952,986 8/1990 Maeda et al. ..... 355/326 X
4,966,356 10/1990 Ohyabu et al. ..... 271/127 X
5,002,266 3/1991 Kikuchi et al. ..... 271/127 X

FOREIGN PATENT DOCUMENTS 57-199737 12/1982 Japan .
1-110440 4/1989 Japan .
1-209253 8/1989 Japan .

*Primary Examiner*—Fred L. Braun
*Attorney, Agent, or Firm*—Jordan B. Bierman

[57] ABSTRACT

An image forming apparatus which includes a recording sheet storage unit disposed within a main body and a feeder for feeding recording sheets from the recording sheet storage unit. Further included is a detector which emits a signal beginning an automatic loading of the recording sheet storage unit into the main body after manual placement of the storage unit at a predetermined position, and the unloading of the recording sheet storage device when such is desired. Further included is a second detector which detects the fully loaded position of the recording sheet storage device, as well as a conveyor for conveying the storage device to the fully loaded position when loaded, and removing the storage device therefrom during unloading.

6 Claims, 5 Drawing Sheets

SHEET LOAD SYSTEM FOR IMAGE FORMING APPARATUS

This application is a continuation of application number 07/672,023 filed Mar. 19, 1991, now abandoned.

BACKGROUND OF THE INVENTION

The present invention relates to a color image forming apparatus which forms color toner images on a belt type image forming unit by the electrophotographic method and transfers the toner images onto a transfer paper to obtain images.

There are various types of color image forming apparatus available. Generally, a belt type image forming apparatus comprises a photosensitive belt stretched between two rollers, and a plurality of developing units containing different color toners mounted along the lower side thereof, by which latent images are formed on the photosensitive belt in accordance with the number of decomposed colors of the original image and developed by the group of developing units while the photosensitive belt is rotated a plurality of times so as to form color images. The color images are transferred onto a transfer paper fed from the paper feed cassette in the cassette storing chamber installed under the group of developing units so as to obtain color copies.

Such a photosensitive belt in a color image forming apparatus has an advantage in that space can be effectively used, because it can make a U-turn in a small curvature and have a flat surface, unlike a photosensitive drum. The photosensitive belt has another advantage in that by installing a separation electrode at the small curvature part, the transfer paper can be easily separated.

In the above color image forming apparatus, the group of developing units are mounted between the photosensitive belt and the cassette storing chamber, and the paper feed path and the paper feed means between the cassette storing chamber and the transfer part of the photosensitive belt are installed along the inner surface of one side wall of the apparatus body, passing round the outside of the group of developing units. The insertion port of the cassette storing chamber is located on the side wall of the apparatus body on the opposite side of installation of the paper feed path and the paper feed means so that paper feed cassettes can be inserted in the paper feed direction.

When such a method in which paper feed cassettes are inserted from the opposite side of the paper feed path and the paper feed means is used, both sides of the apparatus are required to open, when necessary, for removing jammed transfer papers, and a wide space is required for installation of the apparatus, causing problems for copying operation and maintenance.

SUMMARY OF THE INVENTION

The first object of the present invention is to provide an image forming apparatus wherein a paper feed means can be automatically moved and withdrawn by an extremely simple device when inserting or removing paper feed cassettes, and operation and maintenance of the units can be performed from the front of the apparatus.

The second object of the present invention is to provide an image forming apparatus wherein by additionally attaching an extremely simple member to each paper feed cassette, a plurality of paper feed cassettes can be stacked from the front of the apparatus without a movable paper feed guide being particularly required.

The main unit of the image forming apparatus of the present invention comprises a motor for moving a recording paper storage cassette in the horizontal direction, a cassette detection means, and a paper feed device for setting the recording papers in the paper feed state by moving the paper feed roller or by pushing up the recording paper storage cassette or the recording papers in the recording paper storage cassette, after the inserted recording paper storage cassette has been detected by the detection means.

Furthermore, in the image forming apparatus comprising a plurality of recording paper storage cassettes which can be inserted or removed from the recording paper feed side, each of the recording paper storage cassettes has a passage guide at the end thereof so that recording papers can be fed from a recording paper storage cassette positioned below another cassette.

DESCRIPTION OF PREFERRED EMBODIMENTS

Next, the present invention will be described on the basis of an embodiment shown in the accompanying drawings.

Figure 1:
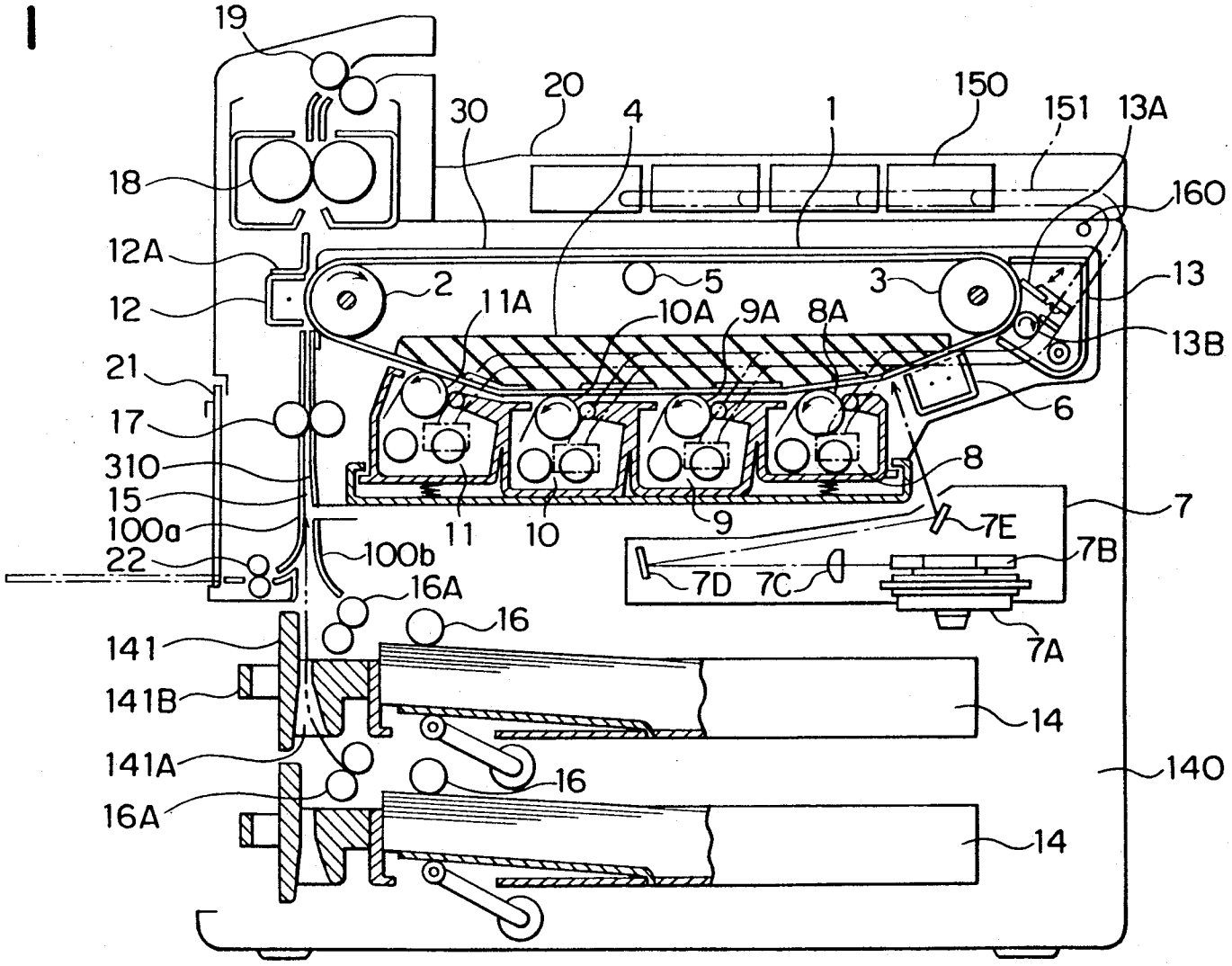
FIG. 1 is a sectional view of an image forming apparatus of the present invention.

In FIG. 1, numeral 1 indicates a flexible photosensitive belt which is a belt type image forming unit. The photosensitive belt 1 is stretched around the drive roller 2 and the follower roller 3, and conveyed clockwise.

Numeral 4 indicates a guide member which is fixed to the apparatus body and which guides the lower side of the photosensitive belt 1, and 5 is a tension roller to keep the photosensitive belt 1 taut on the guide member 4. The guide member 4 and the tension roller 5 make it possible to have a stable image forming surface on the photosensitive belt 1.

Numeral 6 indicates a scorotron charging unit which is a charging means, and 7 is a laser writing unit which is an image exposure means. As the laser writing unit 7, an optical system such as that shown in the FIGURE or an optical system comprising an integrated luminous unit and convergent light transmitter may be used.

Numerals 8, 9, 10, and 11 indicate a plurality of developing units, which are developing means, containing different color developers, for example, yellow, magenta, cyan, and black developers, and the developing units 8, 9, 10, and 11 are provided at positions along the photosensitive belt 1 below the guide member 4. The developing units 8, 9, 10, and 11 comprise developing sleeves 8A, 9A, 10A, and 11A, set at a predetermined distance from the photosensitive belt 1, which develop latent images on the photosensitive belt 1 by the non-contact developing method. The non-contact developing method has an advantage in that the photosensitive belt can move freely, unlike the contact developing method.

Numeral 12 indicates a transfer unit, 12A a discharging bar, and 13 a cleaning unit. The blade 13A of the cleaning unit 13 and the toner conveying roller 13B are kept away from the surface of the photosensitive belt 1 during image forming, and pressed against the surface of the photosensitive belt 1 as shown in the FIGURE only during cleaning after image transfer.

Figure 2:
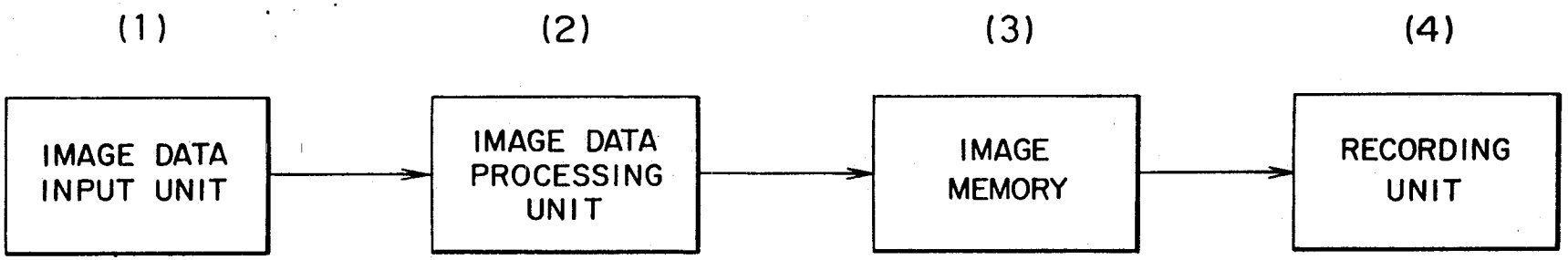
FIG. 2 is a block diagram showing an image forming system.

The color image forming process by the color image forming apparatus is performed as follows:

A multi-color image in this embodiment is formed according to the image forming system shown in FIG. 2. An original image is obtained by a color image data input unit (1) which uses an image pick-up element for scanning, the data is processed by an image data processing unit (2) to create image data, and the image data is stored in an image memory (3). The image memory is retrieved for recording and supplied to a recording unit (4), for example, the color image forming apparatus shown in the embodiment in FIG. 1. When a color signal outputted from an image reading unit which is different from the foregoing printer is supplied to the foregoing laser writing unit 7, a laser beam generated by a semiconductor laser (not shown in the FIGURE) of the laser writing unit 7 is rotated and scanned by the polygon mirror 7B which is rotated by the drive motor 7A, deflected by mirrors 7D and 7E via a $f\theta$ lens 7C, and irradiated onto the surface of the photosensitive belt 1 which is charged beforehand by the charging unit 6 which is a charging means so as to form a bright line.

When the scanning starts, the laser beam is detected by an index sensor and modulated by the first color signal, and the modulated beam scans the surface of the photosensitive belt 1. As a result, by the primary scanning by the laser beam and the secondary scanning by conveying of the photosensitive belt 1, a latent image corresponding to the first color is formed on the surface of the photosensitive belt 1. This latent image is developed by the developing unit 8 of the developing means containing a yellow (Y) toner (a developing medium) to form a toner image on the surface of the belt. The obtained toner image which is retained on the belt surface passes under the blade 13A of the cleaning unit 13 which is kept away from the surface of the photosensitive belt 1 and starts the next copy cycle.

The photosensitive belt 1 is charged once again by the charging unit 6, the second color signal outputted from the signal processing unit is supplied to the laser writing unit 7, and data is written onto the belt surface so as to form a latent image in the same way as with the first color signal. The latent image is developed by the developing unit 9 containing a magenta (M) toner as a second color. The magenta (M) toner image is formed on the foregoing yellow (Y) toner image. In the same way, a cyan (C) toner image is formed by the developing unit 10 containing a cyan (C) toner, and then a black toner image is registrated on the belt surface by the developing unit 11 containing a black toner.

A DC or AC bias voltage is applied to the developing sleeves of the developing units 8, 9, 10, and 11, non-contact jumping development with two-component developer which is a developing means is performed on the photosensitive belt 1 which is grounded. Non-contact development using a single-component developer may also be used.

As mentioned above, a color toner image formed on the surface of the photosensitive belt 1 is transferred onto a recording paper.

A recording paper to be used for transfer is conveyed and fed from the upper or lower recording paper storage cassette (hereinafter called a cassette) in the cassette storage chamber 140 by the rotational actions of the upper or lower paper feed roller 16, which is a paper feed means, depending on the paper size and by the paper ejection roller 16A.

The passage guide 141 with the guide hole (slit) 141A on the front end (the left side of the apparatus shown in FIG. 1) of the apparatus body is mounted and secured to each of the cassettes 14 with adhesive. A recording paper conveyed from the cassette 14 on the lower level passes through the guide hole 141A of the passage guide 141 mounted to the cassette 14 on the upper level, is guided to the paper feed path 15 as shown by a two-dot chain line, and fed to the transfer unit 12 through the paper feed path 15 comprising the conveying guide (a) 100*a*, the conveying guide (b) 1OO*b*, and the cartridge side plate 310.

The cassette 14 is inserted into the cassette storage chamber 140 horizontally from the front of the apparatus body by the handle 141B attached to the passage guide 141, slid along a guide member (not shown in the FIGURE) in the cassette storage chamber 140, and stopped at the mounting location in the paper feed position.

When the cassette 14 is loaded to the apparatus body, the paper feed device installed in the cassette storage chamber 140 operates so as to set the paper feed state.

FIG. 3 shows the operation condition of the paper feed unit when the cassette 14 is inserted.

The cassette 14 has the flat protrusion 14A on the end opposite to the end where the passage guide 141 is mounted, and the rack teeth R are formed on one side.

In the cassette storage chamber 140, motors M1 and M2, the microswitch S1, the photoelectric switch S2 comprising a photocoupler, are installed.

The motor M1 has the pinion P on the revolving shaft thereof. When the cassette 14 is inserted to a predetermined location in the cassette storage chamber 140, the rack teeth R of the cassette 14 are engaged with the pinion P.

The push-up lever 142 is fixed to the revolving shaft of the motor M2 in the horizontal state, and the roller 142A is attached to the head thereof. When the cassette 14 is not at the loading location, the motor M2 is rotated counterclockwise and the roller 142A is kept below the insertion path of the cassette 14.

The paper feed roller 16 is supported by the head of the paper feed lever 16B which rotates around the shaft center of the paper ejection roller 16A, kept at the stop location, which is the lower limit, by the action of an elastic member (not shown in the FIGURE) for rotating the paper feed lever 16B clockwise, and retained above the insertion path of the cassette 14.

Figure 3A:
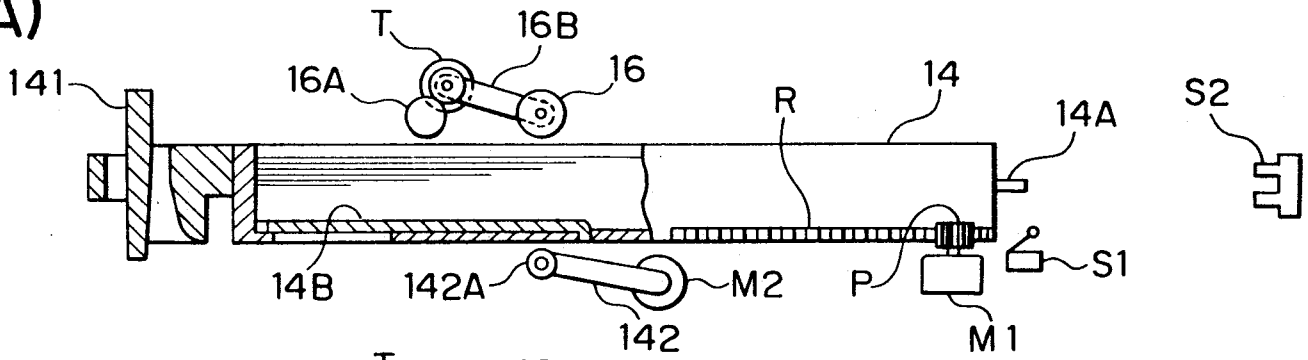
FIG. 3(A) through 3(C) are illustrations showing the various steps in the loading process of a recording paper storage cassette in the apparatus shown in FIG. 1, and FIGS. 4 and 5 are illustrations showing examples of the main unit configuration of the apparatus shown in FIG. 1.

When the cassette 14 is inserted manually to a predetermined location in the cassette storage chamber 140, the rack teeth R of the cassette 14 are engaged with the pinion P of the motor M1 as shown in FIG. 3(A).

Figure 3B:
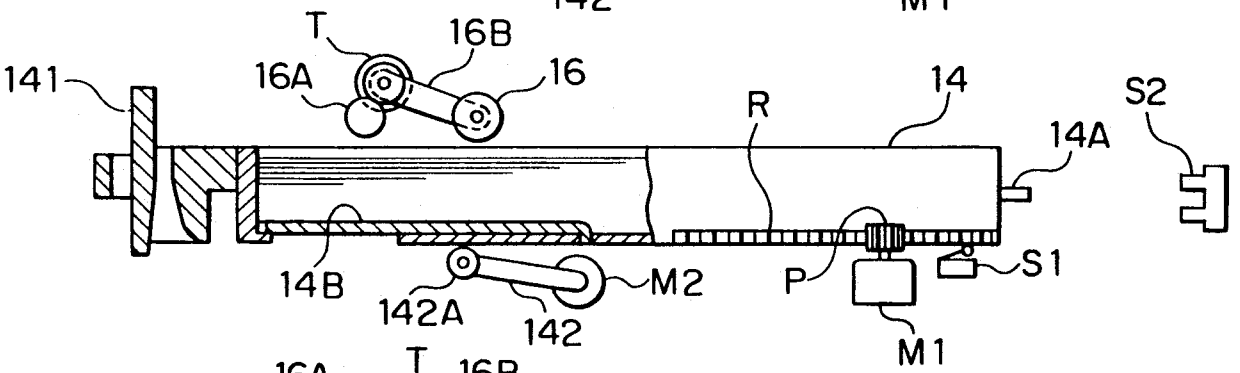

If the cassette 14 is inserted a little further from this location, the microswitch S1 is switched from OFF to ON by the pressure of the bottom of the cassette 14 as shown in FIG. 3(B), the motor M1 operates, and the insertion operation of the cassette 14 is automatically continued by the rotation of the pinion P.

When the cassette 14 reaches the fully loaded location, the photoelectric switch S2 is switched from OFF to ON by the protrusion 14A on the end of the cassette 14, the motor M1 is stopped, and the cassette 14 is left at the location.

When the photoelectric switch S2 is switched from OFF to ON, the motor M2 operates simultaneously so as to rotate the push-up lever 142 clockwise and to push up the bottom plate 14B in the cassette 14 by the roller 142A.

The bottom plate 14B has recording papers loaded on it, and the recording paper on the top pushes up the paper feed roller 16 by the foregoing push-up operation. When the paper feed roller 16 reaches a predetermined height, the torque limiter T attached to the shaft supporting part of the paper feed lever 16B operates so as to return the motor M2 to OFF, keep the recording paper in the contact state with the paper feed roller 16 at a predetermined pressure as shown in FIG. 3(C), and set the cassette 14 in the paper feed state.

Figure 3C:
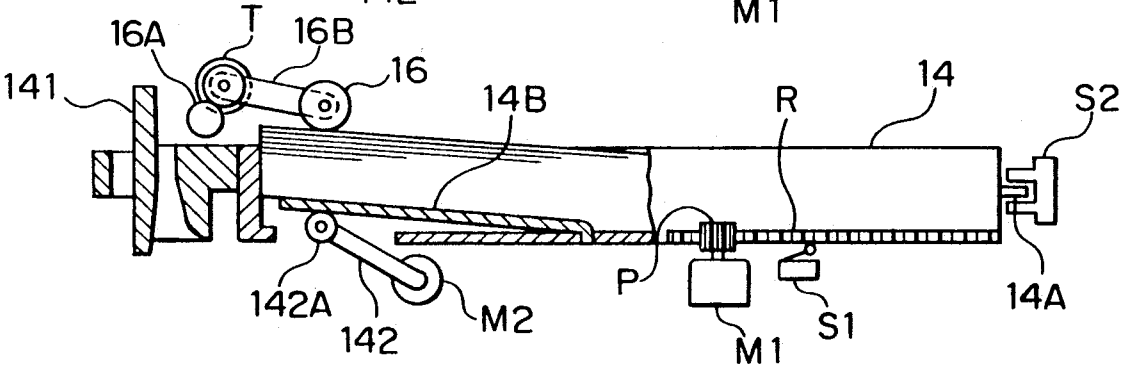

As recording papers are conveyed and fed by the rotation of the paper feed roller 16 and the paper ejection roller 16A in the state shown in FIG. 3(C) and the amount of recording papers loaded on the bottom plate 14B decreases, the paper feed roller 16 lowers and the paper feed lever 16B is returned clockwise. As a result, the foregoing torque limiter T is returned to the initial state, the motor M2 restarts rotation, and the recording papers move up once again so as to keep the paper feed state of the cassette 14 continuously. This operation is performed repeatedly during paper feeding.

When removing the cassette 14 from the cassette storage chamber 140, a cassette release button mounted on the front of the apparatus is pressed. The motors M1 and M2 are switched to the reverse rotation mode and then turned ON, the push-up lever 142 rotates counterclockwise so as to withdraw the roller 142A from the cassette 14, and simultaneously the pinion P rotates reversely so as to convey the cassette 14 automatically to a predetermined location in the cassette storage chamber 140.

Accordingly, when the cassette 14 is pulled out a little by the handle 141B, it can be easily removed from the apparatus body.

In the case of an apparatus in which a slidable tray to load each cassette thereon is provided inside the cassette storage chamber 140, the rack teeth R may be formed on the side of each tray so that the cassette 14 can be loaded on or unloaded from the apparatus by moving the tray.

In this embodiment, recording papers are pressed against the paper feed roller 16 by pushing up the bottom plate 14B. However, the entire cassette 14 may be pushed up and inclined so as to enter the paper feed state.

Furthermore, in order to obtain the paper feed state, the paper feed roller 16 may also be lowered by rotation of the paper feed lever 16B (by means of a motor not shown in the FIGURE) based on a signal from the photoelectric switch S2 so as to come in pressure-contact with the uppermost sheet of paper.

The cassette may be automatically unloaded either in a manner wherein the bottom plate 14B is lowered as stated above, or the inclination of the cassette 14 is brought back to its original condition so that the pressure-contact between the paper feed roller 16 and the recording paper may be released and then the pinion is rotated reversely (by reverse rotation of the motor M1), or in a manner wherein the paper feed roller 16 itself is lifted to release its pressure-contact with the recording paper and to create a clearance between them and then the pinion is rotated reversely.

Recording papers conveyed and fed from the cassette 14 are sent to the paper feed path 15 one by one directly or through the foregoing passage guide 141 and supplied to the transfer unit 12 via timing rollers 17 in synchronization with image forming on the photosensitive belt 1.

As mentioned above, a transfer paper which is supplied to the transfer unit 12, transferred with an image, and discharged is surely separated from the photosensitive belt 1, which changes course suddenly (at a small curvature) around the drive roller 2. After the image has been melted and fixed by fixing rollers 18, the transfer paper is ejected onto the paper ejection tray 20 via the paper ejection rollers 19 and stacked.

The photosensitive belt 1 after image transfer continues conveying, and the cleaning unit 13 puts the blade 13A and the toner conveying roller 13B into the contact state, and removes residual toner. When cleaning is finished, the blade 13A is separated once again, the toner conveying roller 13B removes toner accumulated on the head of the blade 13A a little while later. The toner conveying roller 13B is separated, and then the apparatus starts a new image forming process.

The photosensitive belt 1, the developing units, the charging unit 6, the cleaning unit 13, the inner wall of the paper feed path 15 which is a transfer material conveying path and one of the timing roller 17 are integrated in the cartridge 30, and which can be installed in or removed from the apparatus body as a unit.

When the cartridge 30 is installed in the apparatus body, the toner conveying tube 151 of the toner hopper 150 corresponding to each developing unit is automatically connected to each developing unit so that toner can be fed.

In the foregoing apparatus, paper is automatically fed from the cassette 14, though the apparatus also comprises a means for manual sheet by-pass. In the case of the manual sheet by-pass, the sheet by-pass guide plate 21 mounted on the side of the apparatus body opens horizontally, and inserted recording papers are sent to the paper feed path 15 one by one via the sheet by-pass guide roller 22.

The apparatus body has a clamshell structure which can be divided into upper and lower parts The upper body containing the toner hoppers 150 can be opened, clockwise from the lower body containing the cartridge 30, the laser writing unit 7, and the cassette storage chamber 140, with the hinge 160 shown in FIG. 1 as a fulcrum and retained at that location.

Figure 4:
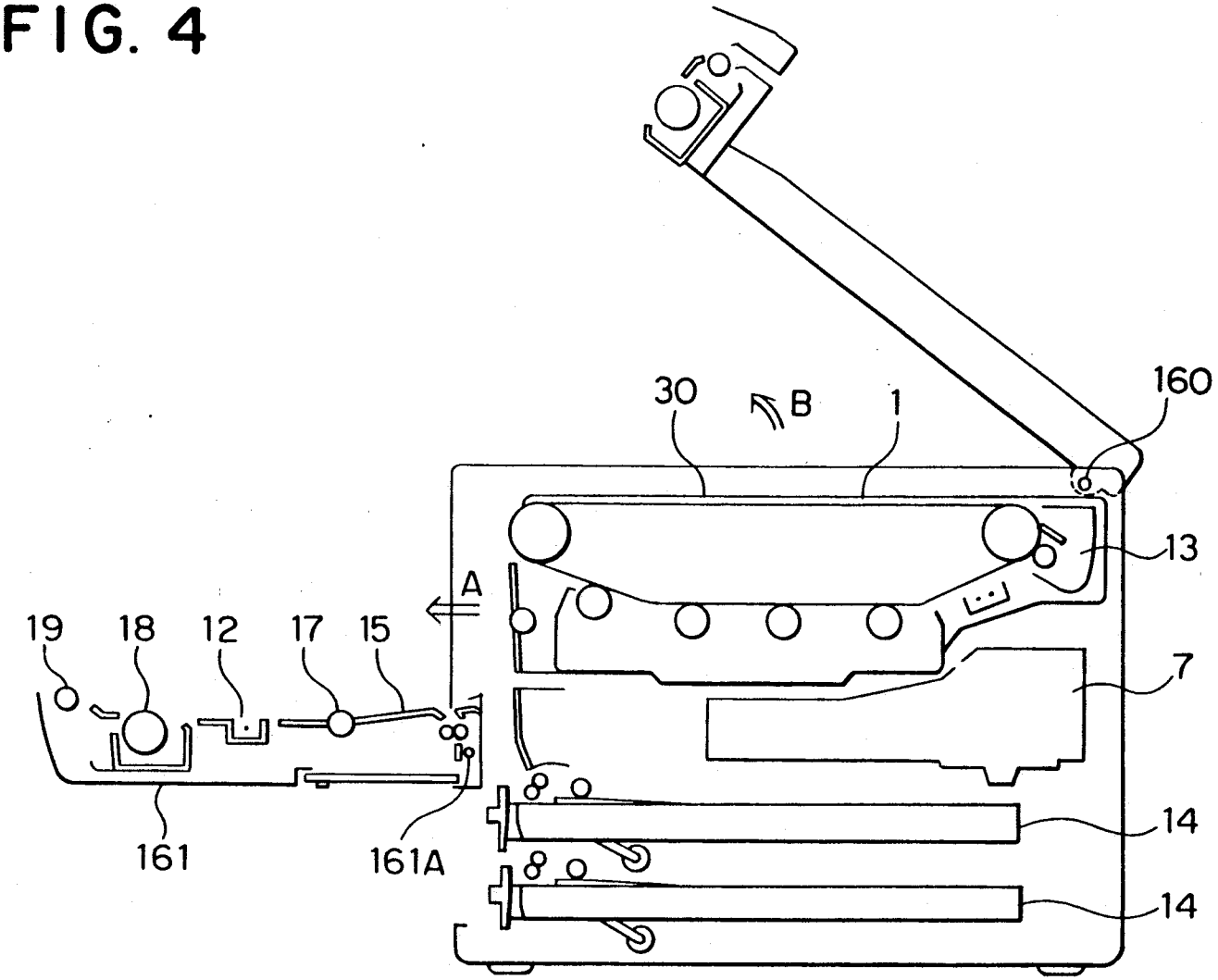

In addition to opening of the upper body, FIG. 4 shows a first configuration example wherein the left side of the lower body is formed by the side cover 161 which is opened or closed with the supporting shaft 161A as a fulcrum. When the side cover 161 is open as shown in the FIGURE, the entire transfer paper conveying path from the paper feed path 15 to the paper ejection rollers 19 is open, and the cartridge 30 can be easily installed in or removed from the lower body by sliding it horizontally in the direction of the arrows A or B.

Figure 5:
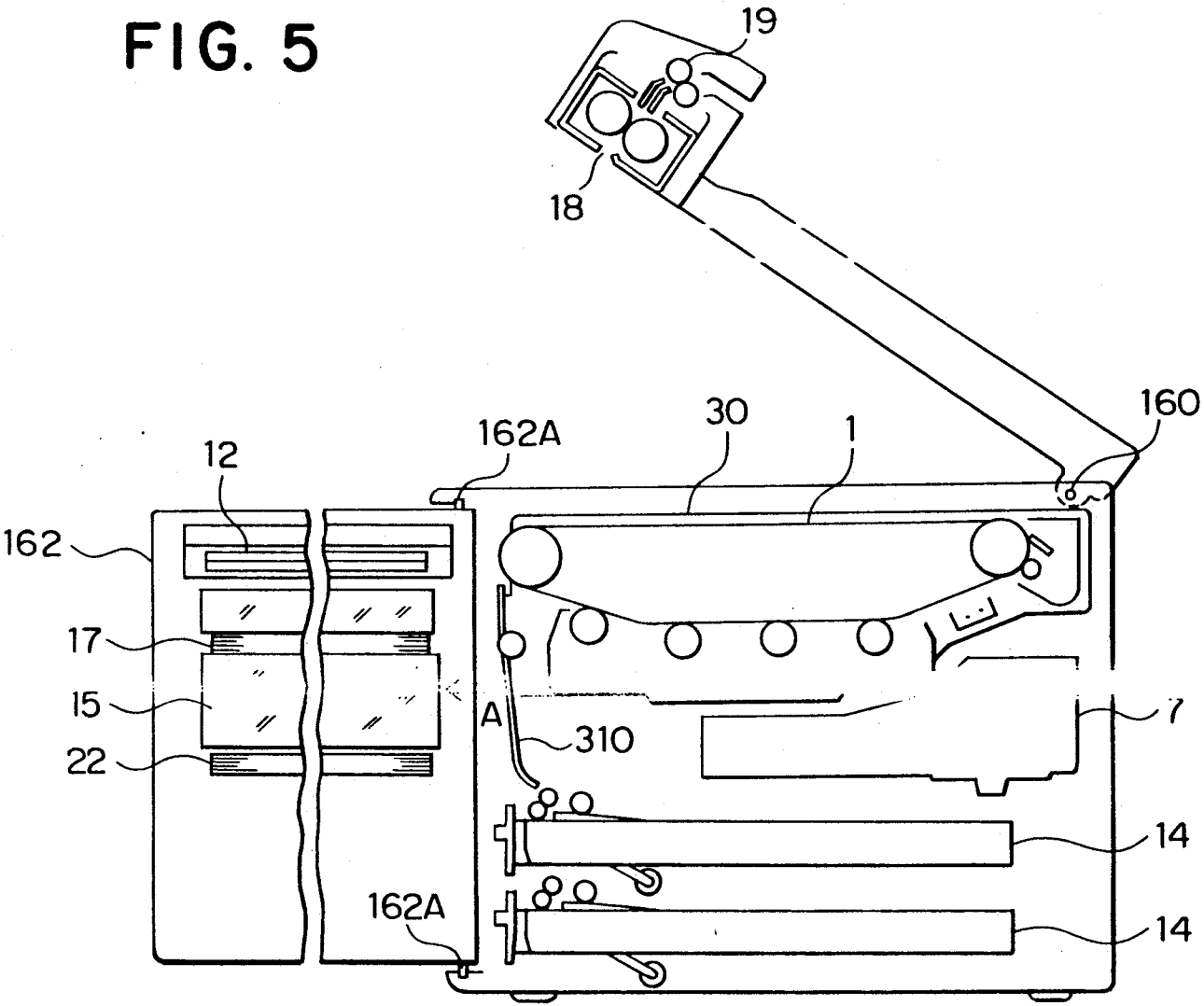

FIG. 5 shows a second configuration example wherein the left side of the lower body is formed by the side cover 162 which is opened or closed horizontally with the supporting shaft 162A as a fulcrum. The transfer unit 12, the sheet by-pass guide plate 21, the sheet by-pass guide roller 22, and one member of each pair of the paper feed path 15 and the timing rollers 17 are attached to the side cover 162.

Therefore, when the side cover 162 is open, the cartridge 30 and the cassette 14 can be installed in or removed from the lower body by sliding them horizontally from the left of the lower body in the direction of the arrow A. As shown in the FIGURE, the cartridge side plate 310 may be extended downward so as to form the paper feed path 15.

In the case of the cartridge in the aforementioned example, a plurality of developing units are not necessarily provided under the cartridge. For example, a process cartridge composed of a photosensitive belt and a cleaning unit may be also employed.

The present invention provides a paper feed device of an extremely simple structure including a paper feed means which can be moved and withdrawn quickly when a recording paper storage cassette is loaded or unloaded, and which sets the cassette surely in the paper feed state at the mounting location. As a result, an image forming apparatus which has superior operability in that recording paper storage cassettes can be automatically loaded or unloaded from the front of the apparatus has been realized.

Furthermore in the present invention, a recording paper conveyed from a recording paper storage cassette at the lower location can be fed surely to the paper feed path in the apparatus by guidance of a storage cassette at the upper location. Therefore, there is no need to install a paper feed guide member particularly in the recording paper conveying unit, and as a result, an image forming apparatus of a simple structure, wherein a plurality of recording paper storage cassettes can be simultaneously loaded, can be provided.

What is claimed is:

1. An image forming apparatus comprising:

(a) a main body;

(b) an image former for forming an image, said image former being disposed in said main body;

(c) a storer for storing recording sheets therein, said storer being loaded into said main body in a first direction;

(d) a feeder for feeding said recording sheets from said storer to said image former in a second direction, wherein said second direction is opposite to said first direction;

(e) a first detector for detecting a predetermined position of said storer wherein, based upon a signal from said first detector, said storer is either engaged and automatically loaded into said main body after manual placement of said storer at said predetermined position, or disengaged and automatically unloaded from said main body;

(f) a second detector for detecting a fully loaded position of said storer; and (g) a conveyor for conveying said storer, during loading, into said main body from said predetermined position to said fully loaded position detected by said second detector, and for conveying said storer to said predetermined position when said storer is being unloaded.

2. The apparatus of claim 1 further comprising an interchangeable process cartridge including said image former, wherein said process cartridge is horizontally detachable in said second direction and horizontally mountable in said first direction.

3. The apparatus of claim 1 wherein said storer has a passage guide at one end thereof whereby said recording sheets can be fed from a storer positioned thereunder.

4. The apparatus of claim 1 wherein when said fully loaded position is detected by said second detector, said feeder is lowered to contact the uppermost sheet of the stack so as to be in a feeding state, said feeder being raised when said storer is being loaded or unloaded.

5. The apparatus of claim 1 further comprising a pusher for pushing up said sheets stacked in said storer, wherein said pusher is kept away from a moving path of said storer when said storer is being loaded or unloaded, and when said storer is in said fully loaded position, said pusher raising the stack of said sheets to a specified position so that the uppermost sheet of the stack is in contact with said feeder.

6. The apparatus of claim 1 wherein there is provided a slidable tray inside said main body on which said storer is placed, said slidable tray being loaded or unloaded by said conveyor.

* * * * *